US011780107B1

(12) United States Patent
Omidi

(10) Patent No.: US 11,780,107 B1
(45) Date of Patent: Oct. 10, 2023

(54) MOVABLE KNIFE BLADE COVER

(71) Applicant: Rayan Omidi, Katy, TX (US)

(72) Inventor: Rayan Omidi, Katy, TX (US)

( * ) Notice: Subject to any disclaimer, the term of this patent is extended or adjusted under 35 U.S.C. 154(b) by 0 days.

(21) Appl. No.: 17/989,615

(22) Filed: Nov. 17, 2022

(51) Int. Cl.
*B26B 29/02* (2006.01)

(52) U.S. Cl.
CPC ..... *B26B 29/02* (2013.01)

(58) Field of Classification Search
None
See application file for complete search history.

(56) References Cited

U.S. PATENT DOCUMENTS 365,714 A * 6/1887 Warner
1,216,381 A * 2/1917 Watson ..... B26B 21/02 30/79
1,222,366 A * 4/1917 Curry ..... B26B 29/02 30/286
4,980,977 A * 1/1991 Matin ..... B26B 29/02 30/2
5,116,351 A * 5/1992 Frassetti ..... A61B 17/3211 30/286
5,250,064 A * 10/1993 Schneider ..... A61B 17/3211 30/151
5,522,828 A * 6/1996 Malilay ..... B26B 29/025 30/329
5,843,107 A * 12/1998 Landis ..... A61B 17/3211 30/155

FOREIGN PATENT DOCUMENTS

KR 20-2014-0001165 * 2/2014
KR 10-2014-0104697 * 8/2014

* cited by examiner

*Primary Examiner* — Hwei-Siu C Payer
(74) *Attorney, Agent, or Firm* — Brett A. Schenck

(57) ABSTRACT

An apparatus is provided that includes a knife and blade cover. The knife includes a handle and a blade. The handle is attached to the blade. The blade includes a cutting edge, a cheek, and an upper spine. The cheek extends between the cutting edge and the upper spine. The apparatus further includes a blade cover. The blade cover covers opposite sides of the cutting edge of the blade. The blade cover covers at least a portion of the upper spine in a stowed position. The apparatus further includes a biasing device. The biasing device is in operative connection with the knife and the blade cover. The biasing device is operative to bias the blade cover down against the upper spine in the stowed position. The blade is in operative connection with the knife. The blade cover is operative to move relative to the blade in a direction away from the cutting edge when the blade cuts an object to enable the blade to cut the object.

6 Claims, 15 Drawing Sheets

MOVABLE KNIFE BLADE COVER

FIELD

This application relates to a movable knife blade cover for protecting fingers and other body parts of a user.

BACKGROUND

Users may cut their fingers of other parts of their body when using cutting knives to cut or chop vegetables, meat or other food items on a cutting board or other flat cutting surface. One known solution to protect the fingers of the user when this occurs is for the user to wear metal gloves or wear a finger guard. However, these solutions reduce control of the knife and feel that the user has during cutting. Hence, it is an objective of the present invention to protect fingers and other parts of the body of a user without wearing anything on the fingers to maintain the same control of the knife and feel that the user has while holding the knife to cut the food items.

SUMMARY

In one aspect of the present invention, an apparatus is provided. The apparatus includes a knife. The knife includes a handle and a blade. The handle is attached to the blade. The blade includes a cutting edge, a cheek, and an upper spine. The cheek extends between the cutting edge and the upper spine. The apparatus further includes a blade cover. The blade cover covers opposite sides of the cutting edge of the blade. The blade cover covers at least a portion of the upper spine in a stowed position. The apparatus further includes a biasing device. The biasing device is in operative connection with the knife and the blade cover. The biasing device is operative to bias the blade cover down against the upper spine in the stowed position. The blade is in operative connection with the knife. The blade cover is operative to move relative to the blade in a direction away from the cutting edge when the blade cuts an object to enable the blade to cut the object.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 2:
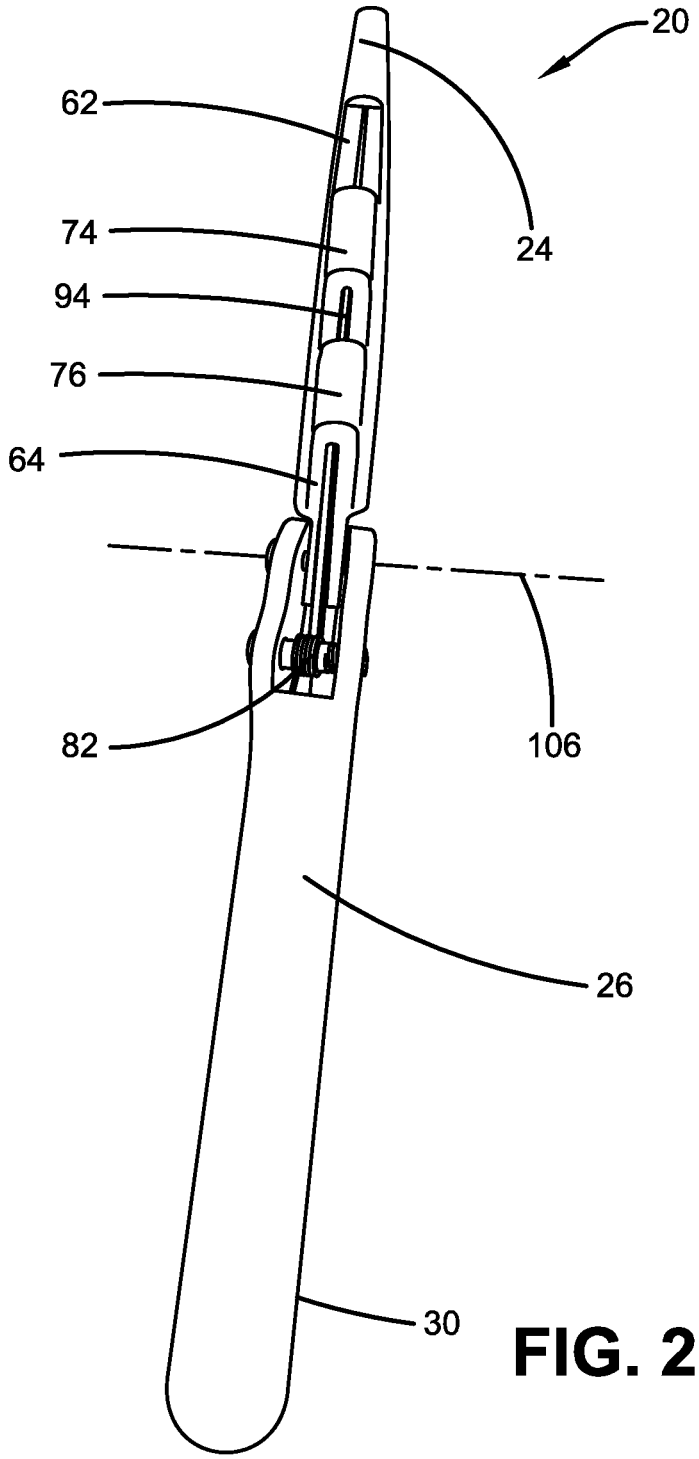
FIG. 2 is a top and rear perspective view of the apparatus of FIG. 1 in a stowed position.

Throughout the present description, the terms "upper", "lower", "top", "bottom", "left", "right", "front", "forward", "rear", and "rearward" shall define directions or orientations with respect to the apparatus as illustrated in FIG. 2, which shows a top and rear perspective view of the apparatus of the present invention. It will be understood that the spatially relative terms "upper", "lower", "top", "bottom", "left", "right", "front", "forward", "rear", and "rearward" are intended to encompass different orientations of the apparatus in use or operation in addition to the orientation depicted in the figures. For example, if the apparatus in the figures is turned over, elements described as "upper" elements or features would then be "lower" elements or features.

Figure 1:
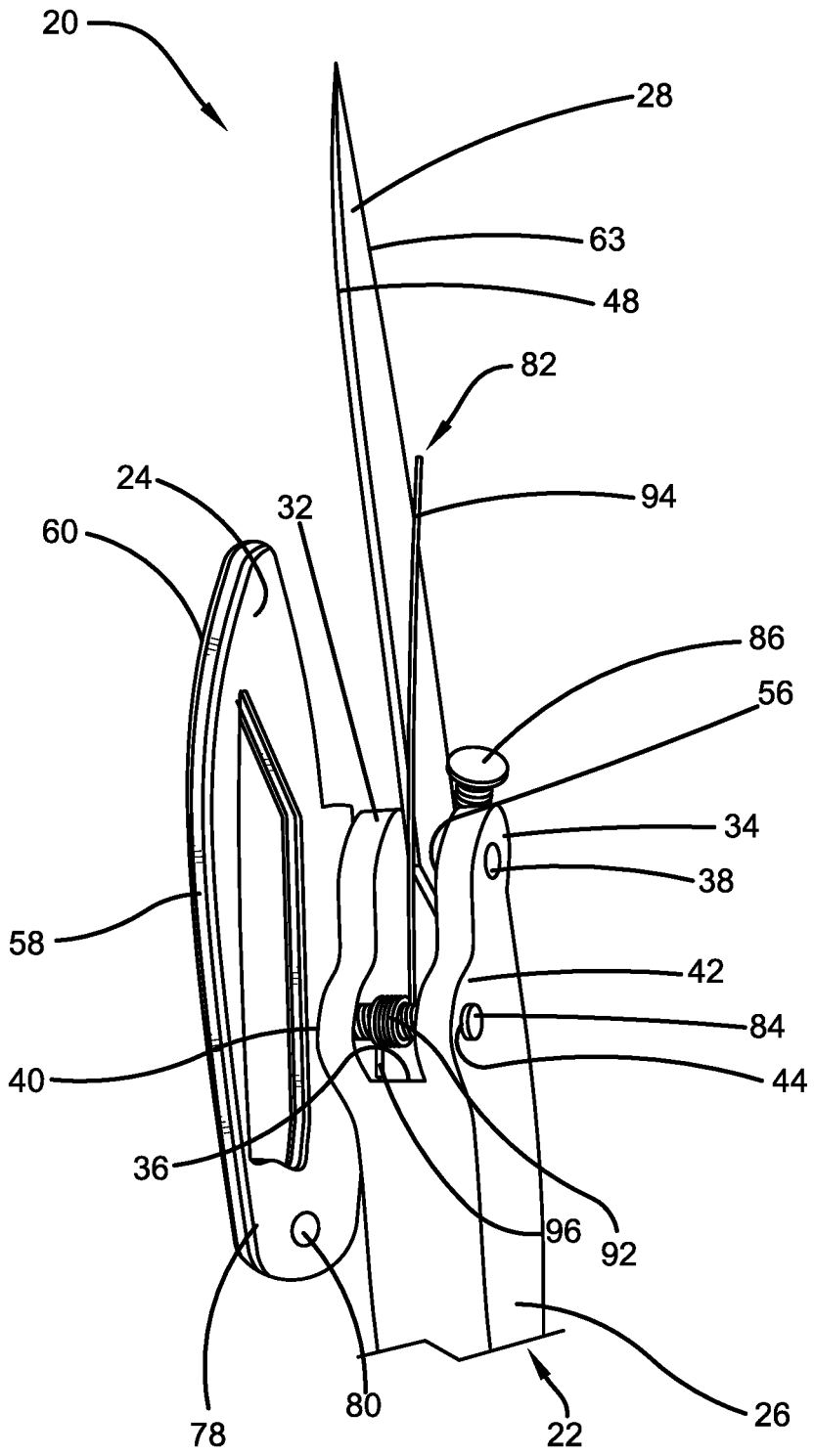
FIG. 1 is a top and rear perspective view of a portion of an apparatus according to a first embodiment of the present invention with some parts exploded for illustrative purposes.

FIG. 1 shows an apparatus 20 that comprises a knife 22 and a blade cover 24. The knife 22 comprises a handle 26 and a blade 28. The handle 26 may be made of a suitable material such as wood, thermoplastic elastomer, fiber glass reinforced nylon, or metal. The handle 26 includes a grip portion 30 (FIG. 2) for the user to grasp. The handle 26 includes a lower pair of opposite right and left mounting tabs 32, 34 that are integrally formed in one piece with the grip portion 30 and extend from the front end 36 of the grip portion 30. The lower pair of mounting tabs 32, 34 are spaced from each other and oriented parallel with the knife blade 28. Each of the mounting tabs 32, 34 includes a threaded lateral mounting aperture 38. The mounting apertures 38 of the lower pair of mounting tabs 32, 34 are aligned with each other. The handle 26 further includes an upper pair of opposite right and left mounting tabs 40, 42 that are integrally formed in one piece with the grip portion 30. The upper pair of mounting tabs 40, 42 extend upwardly from the front end 36 of the grip portion 30. The mounting tabs 40, 42 are space from each other and oriented parallel with the knife blade 28. Each of the mounting tabs 40, 42 includes a threaded lateral mounting aperture 44 (FIG. 1). The mounting apertures 44 of the upper pair of mounting tabs 40, 42 are aligned with each other. The upper pair of mounting apertures 40, 42 is positioned higher than the blade 28.

Figure 4:
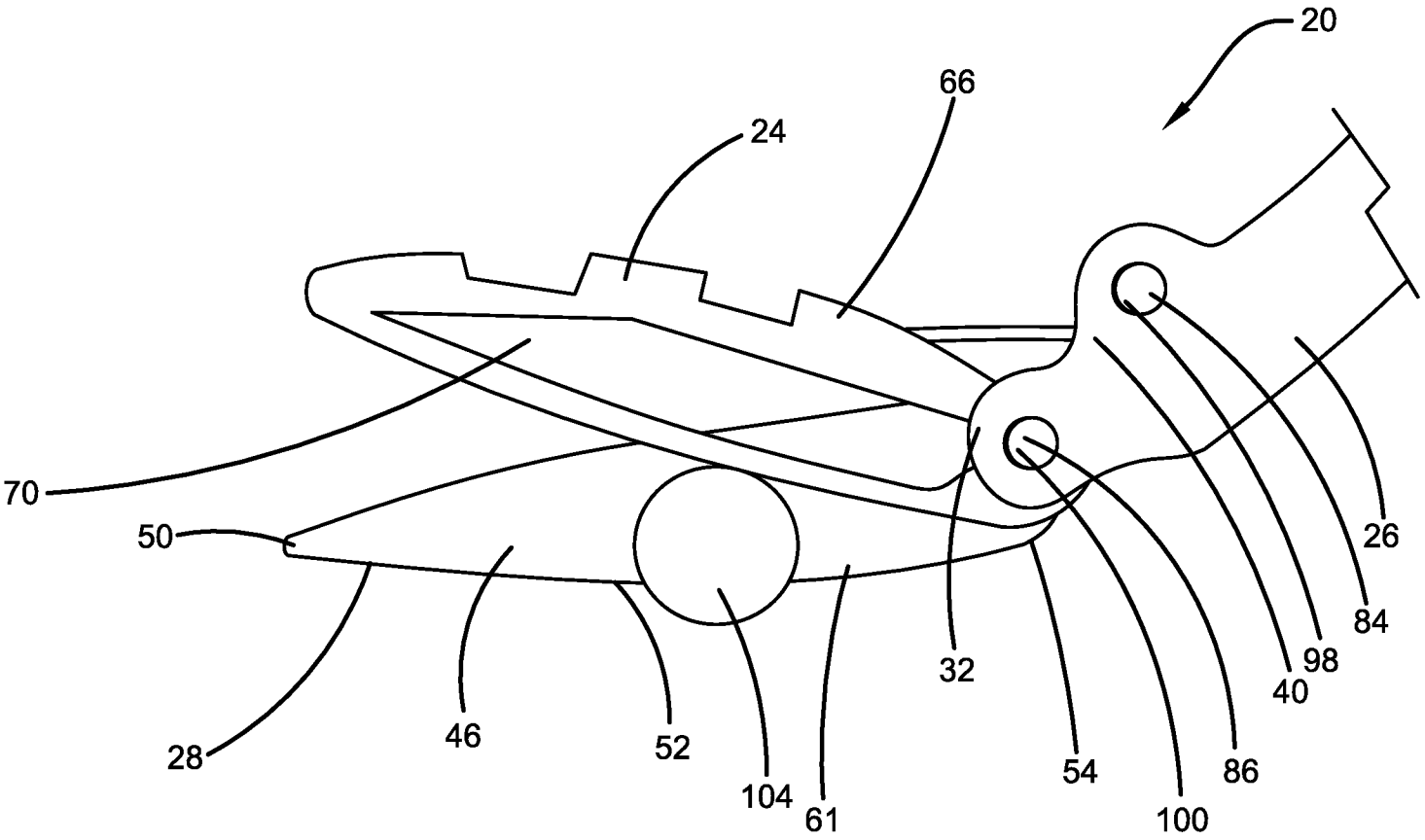
FIG. 4 is a right side view of a portion of the apparatus of FIG. 1 in the operative position cutting a food item.

As illustrated in FIG. 4, the blade 28 includes a cheek 46, an upper spine 48 (FIG. 1), a tip 50, a cutting edge 52, and a tang 54. The tang 54 extends into the handle 26 between the lower pair of mounting tabs 32, 34 and is attached to the handle 26 by any suitable way such as by rivets. At least one mounting aperture 56 (FIG. 1) of the tang 54 is located on the front of the tang and is sandwiched between the right and left mounting tabs 32, 34 of the lower pair of mounting tabs 32, 34 such that the front mounting aperture 56 is aligned with the mounting apertures 38 of the lower pair of mounting tabs 32, 34.

Figure 5:
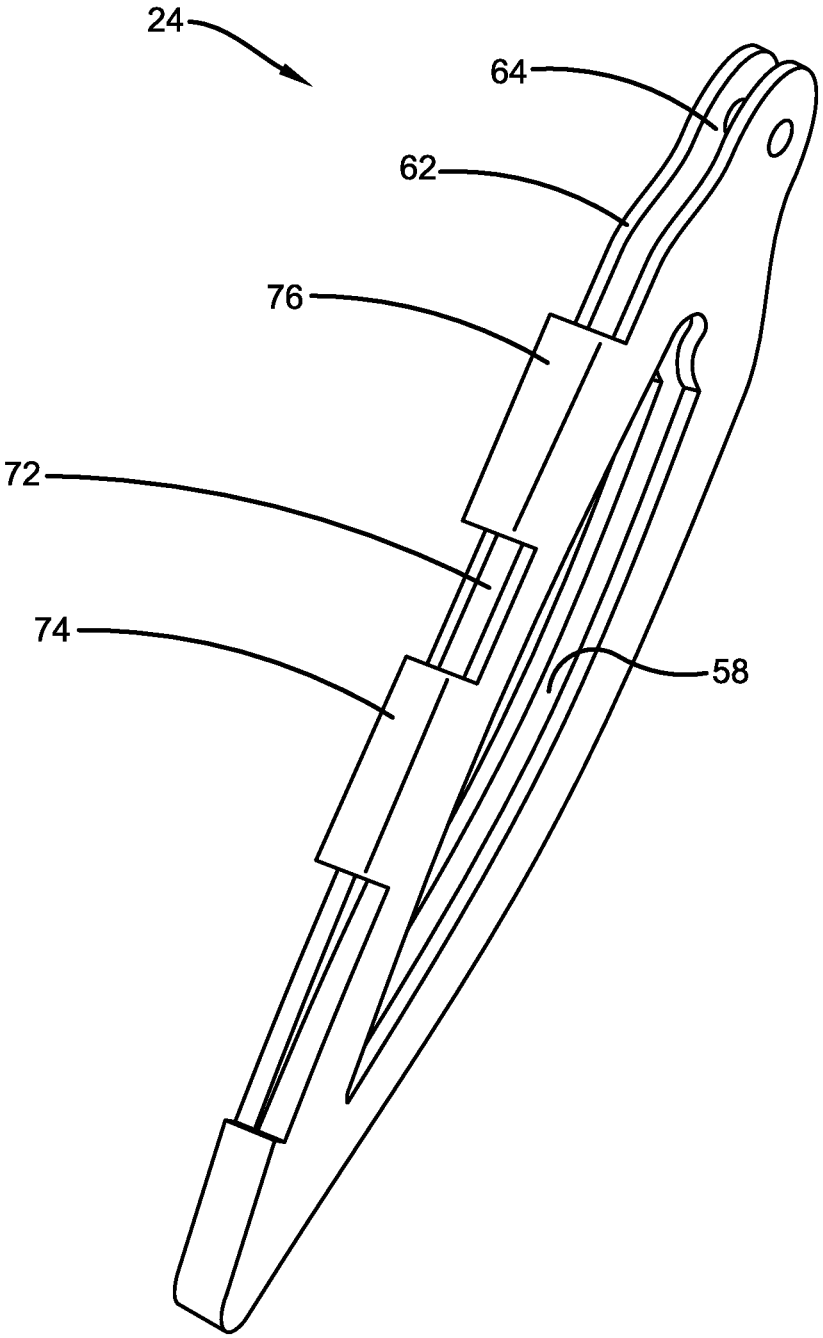
FIG. 5 is a top perspective view of the knife blade cover of the apparatus of FIG. 1.

The cover 24 includes a bottom groove 58 that extends upwardly from the bottom end 60 of the cover 24 to the top end 62 (FIG. 2) of the cover 24. The bottom groove 58 is opened at the bottom end 60 of the cover 24, but closed at the top end 62 of the cover 24 except for being opened at a rear access portion 64 (FIGS. 2 and 5) of the top end 62. The bottom groove 58 is defined by right and left guard members 66, 68. The right and left guard members 66, 68 cover the right and left sides 61, 63 of the cutting edge 52, the upper spine 48, and the tip 50 of the blade 28 when installed on the blade 28 in the stowed position of the apparatus 20. The right and left guard members 66, 68 may extend downwardly beyond the cutting edge 52 in the stowed position at a distance of 1 to 3 millimeters. In one example, the right and left guard members 66, 68 may extend downwardly beyond the cutting edge 52 in the stowed position at a distance of 1 millimeter. Each of the right and left guard members 66, 68 may have a thickness (from right to left) from 1 to 10 millimeters. In one example, the right and left guard members 66, 68 may have a thickness (from right to left) of 2 millimeters. An inner opening 70 is formed in the right and left guard members 66, 68 to expose portions of the cheek 46 of the blade 28. A top groove 72 (FIG. 3) is formed at the top end 62 of the cover 24. The top groove 72 is partially covered by longitudinally spaced front and rear sleeve portions 74, 76 that extend over the top of groove 72 and span the width of the groove 72. The sleeve portions 74, 76 are integrally formed in one piece with the cover 24. The cover 24 includes a rear corner end 78 (FIG. 1) that is positioned between the right and left mounting tabs 32, 34 of the lower pair of mounting tabs 32, 34 when the cover is on the blade 28 and the blade 28 is attached to the handle 26. The rear corner end 78 includes a rear mounting aperture 80 (FIG. 1) that is aligned with the front mounting aperture 56 of the tang 54.

Figure 3:
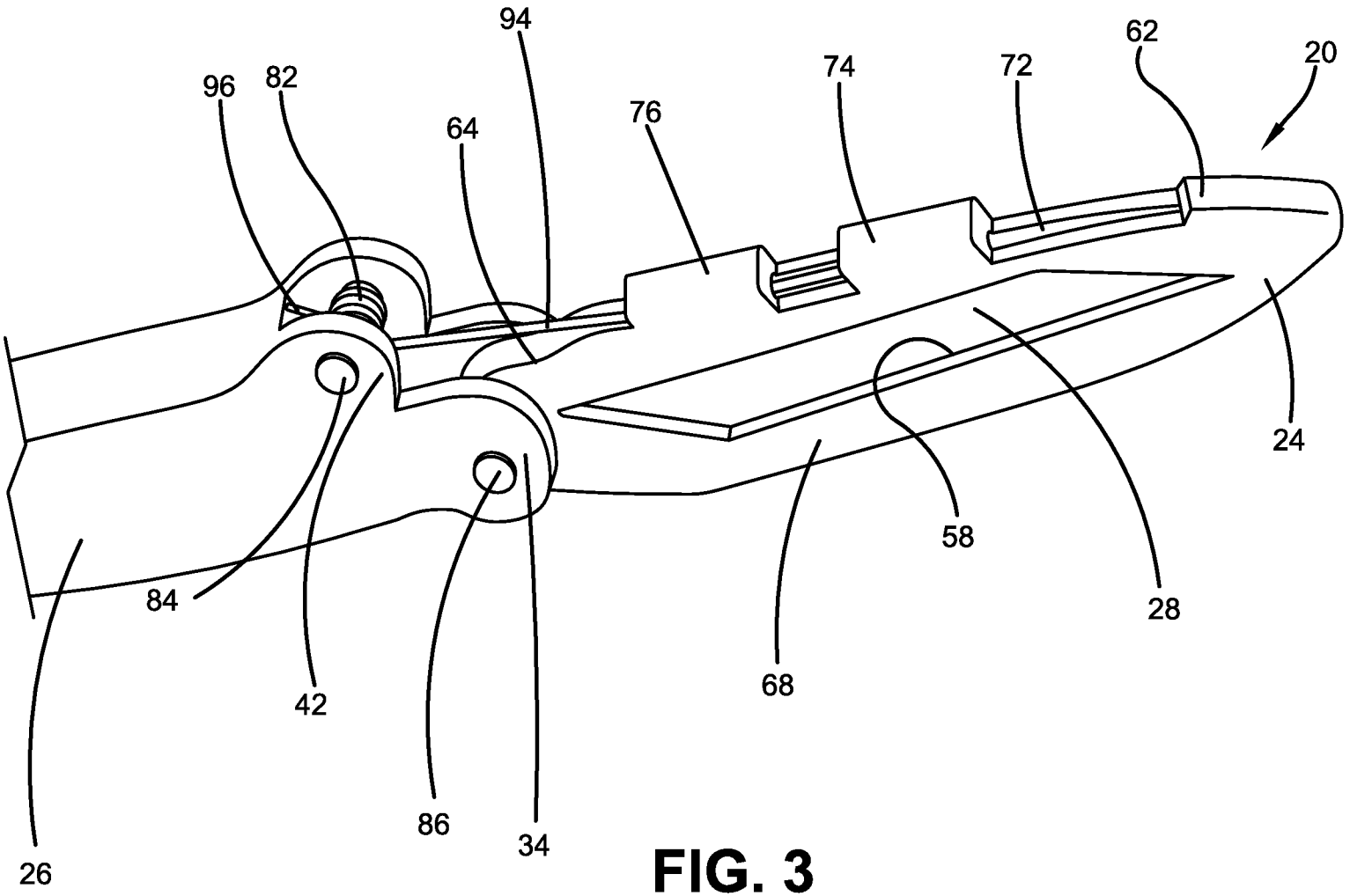
FIG. 3 is a left side perspective view of a portion of the apparatus of FIG. 1 in the stowed position.

The apparatus 20 further includes a torsional spring 82 and upper and lower threaded bolts 84, 86 as illustrated in FIG. 1. The torsional spring 82 includes a coiled portion 92, a front leg 94, and a rear leg 96. The coiled portion 92 is located between the right and left mounting tabs 40, 42 of the upper pair of the mounting tabs 40, 42. The front leg 94 is elongated and extends forwardly from the coiled portion 92 and the rear leg 96 extends rearwardly from the coiled portion 92. The upper threaded bolt 84 extends through the apertures 44 and the coiled portion 92 with a button head 98 (FIG. 4) of the upper threaded bolt 84 engaging the right mounting tab 40. The upper threaded bolt 84 threadily engages the apertures to secure the upper threaded bolt 84 and torsional spring 82 to the handle 26. The rear leg 96 engages the front end 36 of the handle 26 as seen in FIGS. 1 and 3. The front leg 94 extends along the top groove 72 of the cover 24 and also extends through the sleeve portions 74, 76. The lower threaded bolt 86 extends through the mounting apertures 38 of the lower pair of mounting tabs 32, 34, the rear mounting aperture 80 of the cover 24, and the front mounting aperture 56 of the tang 54 of the blade 28. A button head 100 (FIG. 4) of the lower threaded bolt 86 engages the right mounting tab 32. The lower threaded bolt 86 threadily engages the mounting tabs 32, 34 via the apertures 38 to pivotally connect the cover 24 to the blade 28 and the handle 26 as depicted in FIGS. 2-4. When the apparatus 20 is assembled, the rear leg 96 of the torsional spring 82 urges the knife cover 24 to cover the blade 28 in the stowed position when the knife 22 is not be used.

To assemble the apparatus 20, the tang 54 of the blade 28 is inserted between the lower pair of mounting tabs 32, 34 with the front mounting aperture 56 aligned with the mounting apertures 38. The tang 54 is then attached to the handle 26. Next, the torsional spring 82 is positioned between the upper pair of mounting tabs 40, 42 such that the rear leg 96 of the torsional spring 82 engages the rear end 36 of the handle 26. The upper threaded bolt 84 is then inserted through the coiled portion 92 of the torsional spring 82 and the mounting apertures 44 such that the upper threaded bolt 84 threadily engages the mounting tabs 40, 42 via the mounting apertures 44 to secure the torsional spring 82 to the handle 26. The tip 50 of the blade 28 is then inserted into the rear access portion 64 of the bottom groove 58 of the cover 24. The blade 28 is slid forwardly in the bottom groove 58 until the tip 50 reaches the front portion of the cover 24 and the rear mounting aperture 80 of the cover 24 is aligned with the front mounting aperture 56 of the tang 54 and the mounting apertures 38 of the left and right mounting tabs 34, 32. Simultaneously, with the blade 28 sliding forward in the bottom groove 58, the front leg 94 of the torsional spring 82 is inserted into the front and rear sleeve portions 74, 76 and the top groove 72. Then, the lower threaded bolt 86 is inserted through the apertures 38 of the lower pair of mounting tabs 32, 34, the front aperture 56 of the tang 54, and the rear mounting aperture 80 of the cover 24 such that the lower threaded bolt 86 threadily engages the mounting tabs 32, 34 via the mounting apertures 38 to pivotally connect the cover 24 to the blade 28 and the handle 26.

In operation, the apparatus 20 is placed in the stowed position (FIGS. 2 and 3). In the stowed position, the blade 28 is covered by the cover 24 such that the right and left guard members 66, 68 cover the cutting edge 52, the upper spine 48 and the tip 50 of the blade 28 to prevent a user or other person from contacting the cutting edge 52, the upper spine 48 or the tip 50 of the blade 28 and cutting themselves. To cut a food item 104 (FIG. 4), the knife 22 is placed over the food item 104 to be cut. As the knife 22 cuts into the food item 104 in this operative position, the biasing force of the torsional spring 82 is overcome by the resistance force of the food item 104 being applied against the bottom end 60 of the cover 24 such that the cover 24 pivots upwardly relative to the blade about an axis 106 (FIG. 2) that is coaxial with the longitudinal axis of the lower threaded bolt 86, and away from the cutting edge 52 to enable the knife 22 the to cut through the food item 104 as illustrated in FIG. 4. Also, as the cover pivots upwardly about the axis 106, the front leg 94 of the torsional spring 82 slides forwardly through the sleeve portions 74, 76 and along the top groove 72. When the blade 28 and the cover 24 are removed from the food item 104, there is no more resistance force from the food item 104 being applied against the bottom end 60 of the cover 24, so that the downward biasing force of the torsional spring 82 due to the tension of the torsional spring 82 pivotally moves the cover 24 back downwardly until the top end 62 of the cover 24 engages the upper spine 48 of the blade 28, thereby placing the cover 24 in the stowed position as illustrated in FIGS. 2 and 3. Also, as the cover pivots back downwardly about the axis 106, the front leg 94 of the torsional spring 82 slides rearwardly through the sleeve portions 74, 76 and along the top groove 72.

Figure 6:
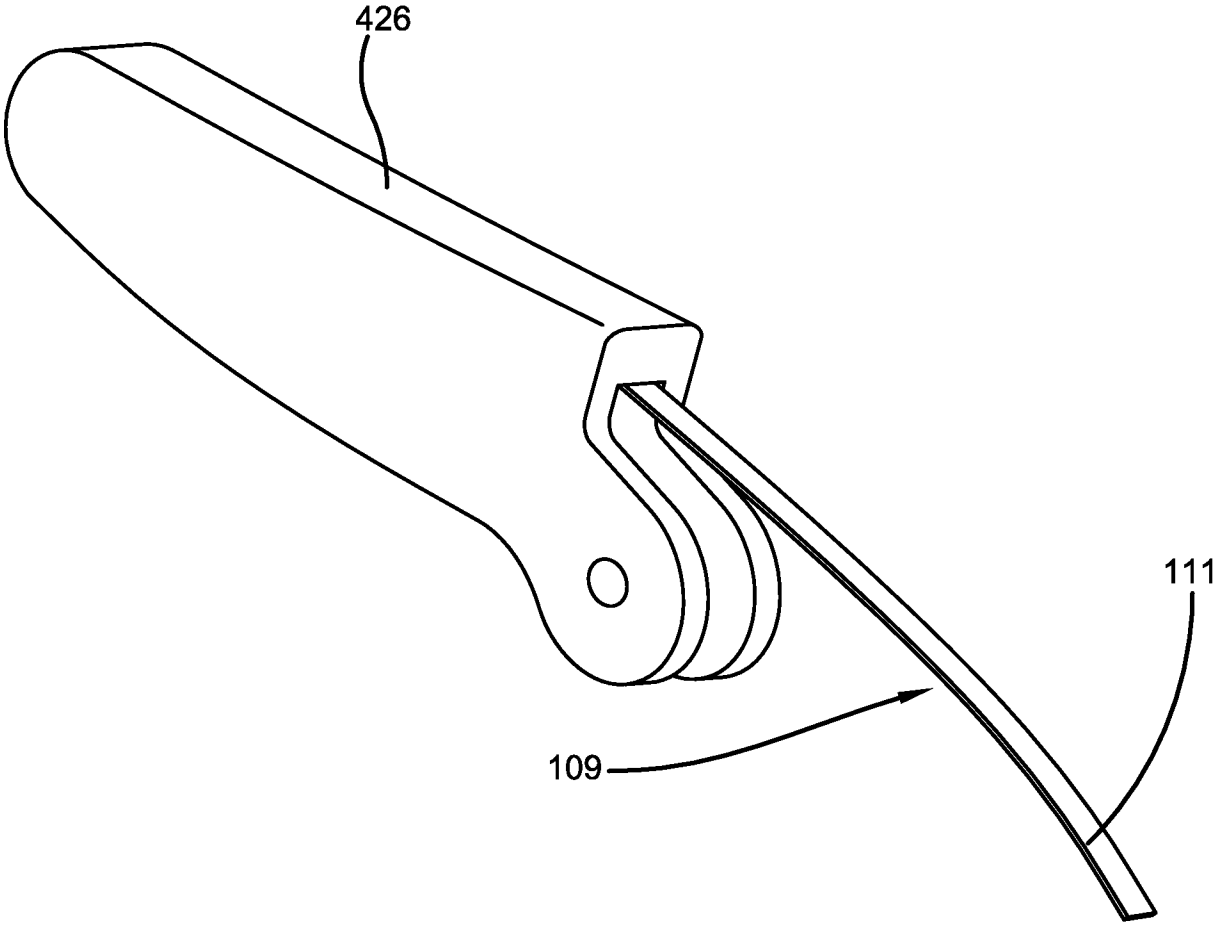
FIG. 6 is a front and left perspective view of another version of the handle of the apparatus of FIG. 1 with a flat spring attached to the handle.

Instead of a torsional spring 82, the spring may be a flat spring 109. As illustrated in FIG. 6, the flat spring 109 may comprise an elongated flat leg 111 that is attached to another version of a handle 426 that extends through the sleeve portions 74, 76. The handle 426 is similar to the handle 26 of FIG. 1 except that it does not include the upper pair of mounting tabs 40, 42.

Figure 7:
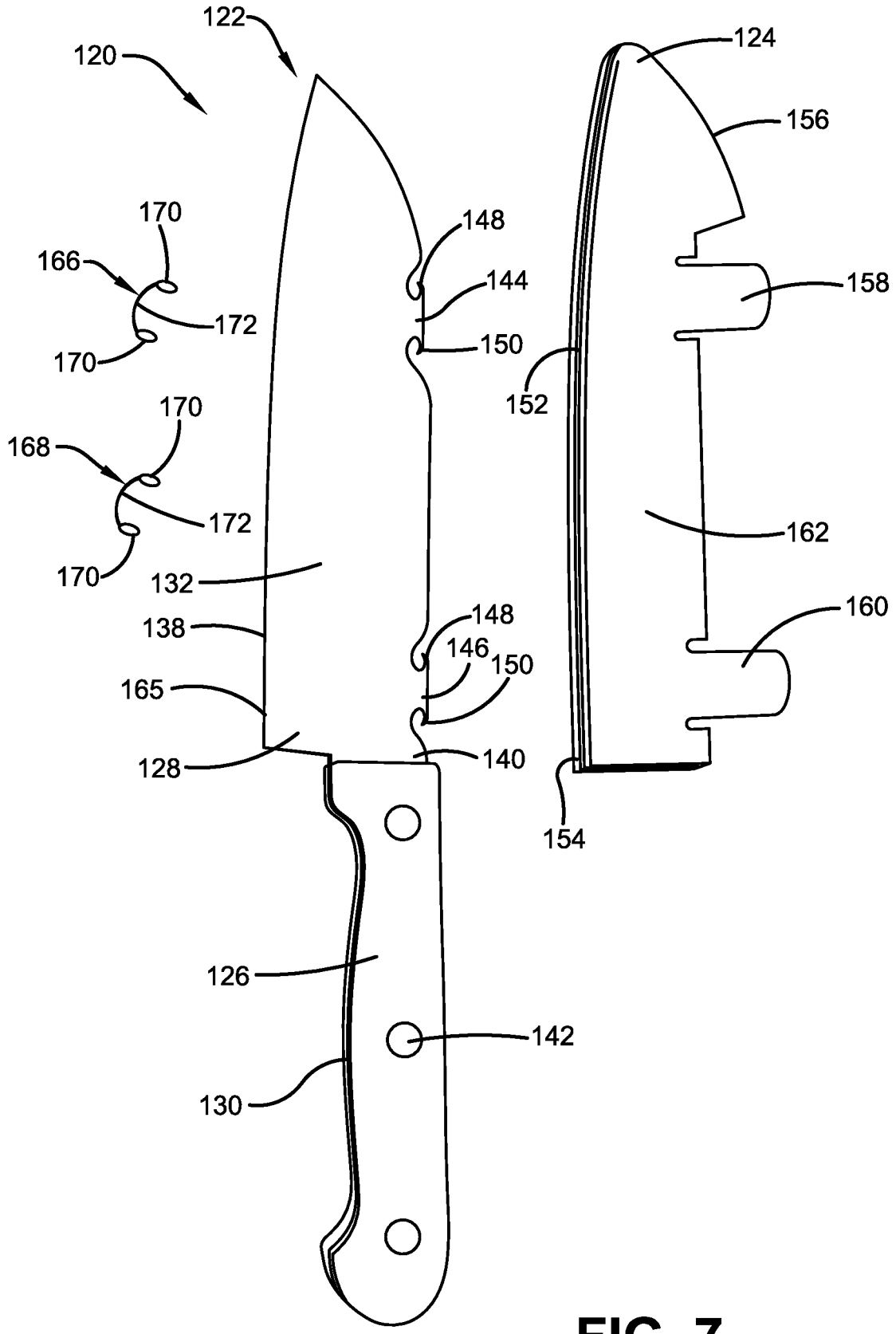
FIG. 7 is a partial exploded view of an apparatus from the right side according to a second embodiment of the present invention.
Figure 8:
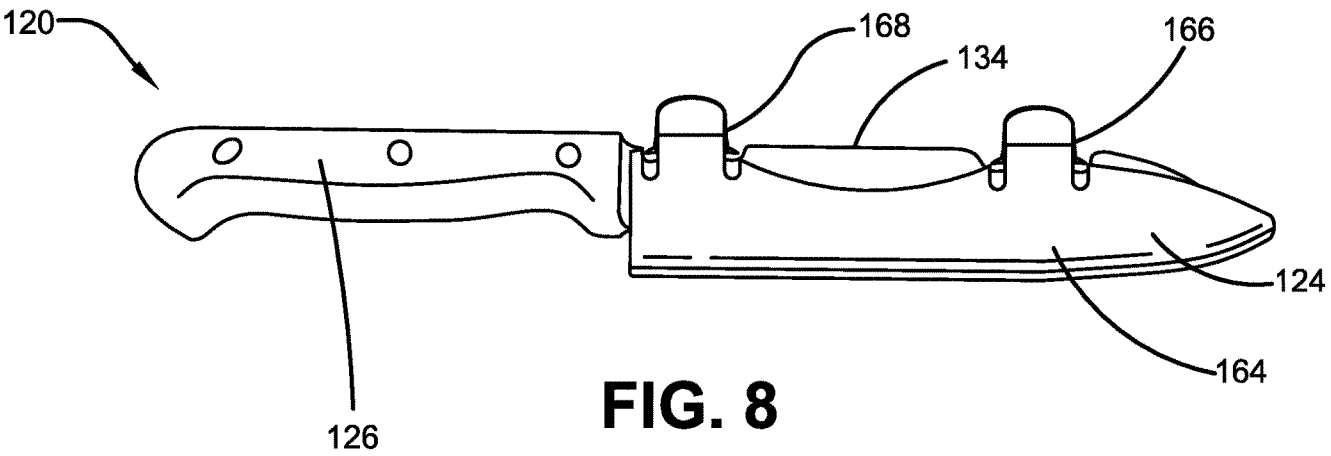
FIG. 8 is a left side view of the apparatus of FIG. 7 in a stowed position.
Figure 9:
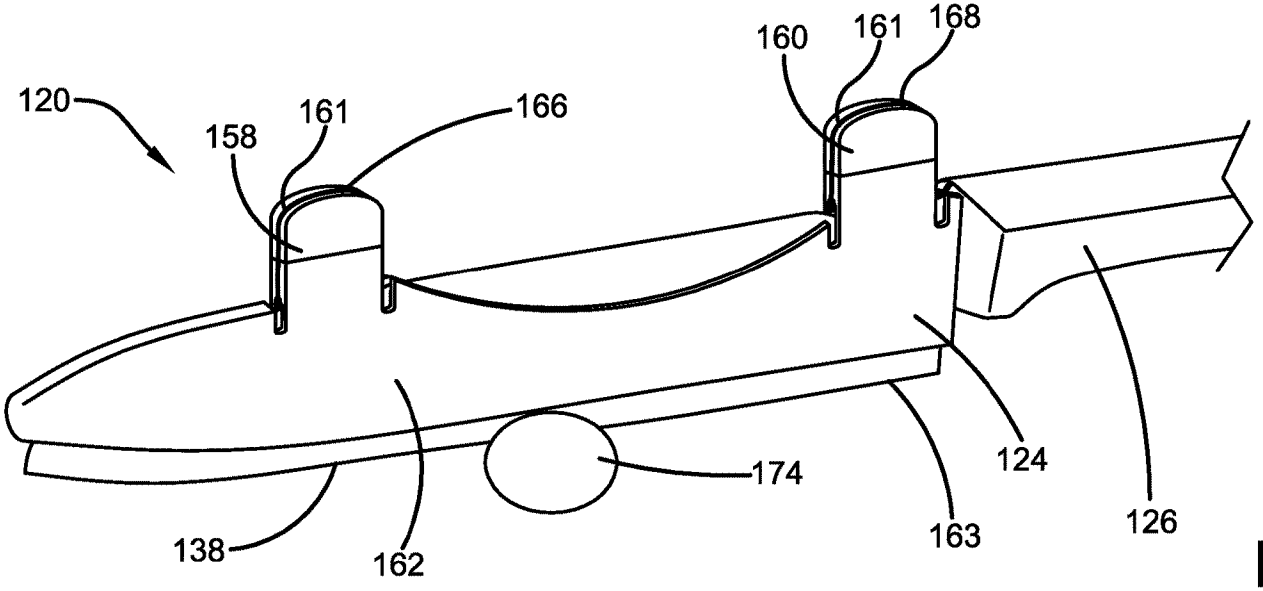
FIG. 9 is a right side perspective view of a portion of the apparatus of FIG. 7 in an operative position cutting a food item.

FIGS. 7-9 show an apparatus 120 according to a second embodiment of the present invention. Referring to FIG. 7, the apparatus 120 comprises a knife 122 and a blade cover 124. The knife 122 includes a handle 126 and a blade 128 attached to each other. The handle 126 may be made of a suitable material such as wood, thermoplastic elastomer, fiber glass reinforced nylon, or metal. The handle 126 includes a grip portion 130 for the user to grasp. The blade 128 includes a cheek 132, an upper spine 134, a tip 136, a cutting edge 138, and a tang 140. The tang 140 extends into the handle 126 and is attached to the handle 126 by any suitable way such as by rivets 142. Front and rear tabs 144, 146 are integrally formed in one piece with the upper spine 134. Each of the tabs 144, 146 extends upwardly beyond the upper spine 134 and includes front and rear hooks 148, 150. The front hook 148 extends forwardly from the front end of the tab 144 or 146, 16 and the rear hook 150 extends rearwardly from the rear end of the tab 144 or 146. The hooks 148, 150 are spaced longitudinally from each other along the upper spine 134.

The cover 124 includes a bottom slot 152 that extends upwardly from the bottom end 154 of the cover 124 to the top 156 of the cover 124. The top 156 of the cover 124 includes front and rear stop cover portions 158, 160 that are covered and extend upwardly from the top 156 of the cover 124. Each of the stop cover portions 158, 160 includes a top groove 161 (FIG. 9) that extends along the top edge of the stop cover portion. The bottom slot 152 is defined by right and left guard members 162, 164. The right and left guard members 162, 164 cover the right and left sides 163, 165 of the cutting edge 138, the upper spine 134, and the tip 136 of the blade 128 when installed on the blade 128 in the stowed position of the knife 122. The right and left guard members 162, 164 may extend downwardly beyond the cutting edge 138 in the stowed position at a distance of 1 to 3 millimeters. In one example, the right and left guard members 162, 164 may extend downwardly beyond the cutting edge 138 in the stowed position at a distance of 1 millimeter. Each of the right and left guard members 162, 164 may have a thickness (from right to left) from 1 to 10 millimeters. In one example, the right and left guard members 162, 164 may have a thickness (from right to left) of 2 millimeters.

The apparatus 120 also includes front and rear springs 166, 168 that define a biasing device. Each of the springs 166, 168 has looped axial ends 170 that are connected to each other by a flexible wire 172. When the cover 124 is assembled to the blade 128, the front and rear stop cover portions 158, 160 cover their respective front and rear tabs 144, 146 except at the front and rear hooks 148, 150. In the assembled condition of the cover 124 on the blade 128, the wire 172 of the front spring 166 is inserted into the top groove 161 of the front stop cover portion 158 and the front and rear hooks 148, 150 are hooked into their respective looped ends 170 of the front spring 166. Similarly, the wire 172 of the rear spring 168 is inserted into the top groove 161 of the rear stop cover portion 160 and the front and rear hooks 148, 150 are hooked into their respective looped ends 170 of the rear spring 168. The biasing force of the front and rear springs 166, 168 urge the cover 124 downward against the upper spine 134 of the blade 128. Alternatively, biasing device may be clear elastic stretch lines or clear rubber bands instead of the front and rear springs 166, 168.

To cut a food item 174, the apparatus 120 is placed over the food item 174 to be cut. As the knife 122 cuts into the food item 174 in this operative position, the biasing force of the springs 166, 168 is overcome by the resistance force of the food item 174 being applied against the bottom end 154 of the cover 124 such that the cover 124 moves upwardly relative to the blade 128 away from cutting edge 138 to enable the knife 122 to cut through the food item 174 as illustrated in FIG. 9. When the blade 128 and cover 124 are removed from the food item 174, there is no more resistance force from the food item 174 being applied against the bottom end 154 of the cover 124, so that the downward biasing force of the springs 166, 168 due to the tension of the springs 166, 168 causes the cover 124 to move back downwardly until the stop cover portions 158, 160 engage the upper spine 134 of the blade 128, thereby placing the knife cover 124 in the stowed position as illustrated in FIG. 8.

Figure 10:
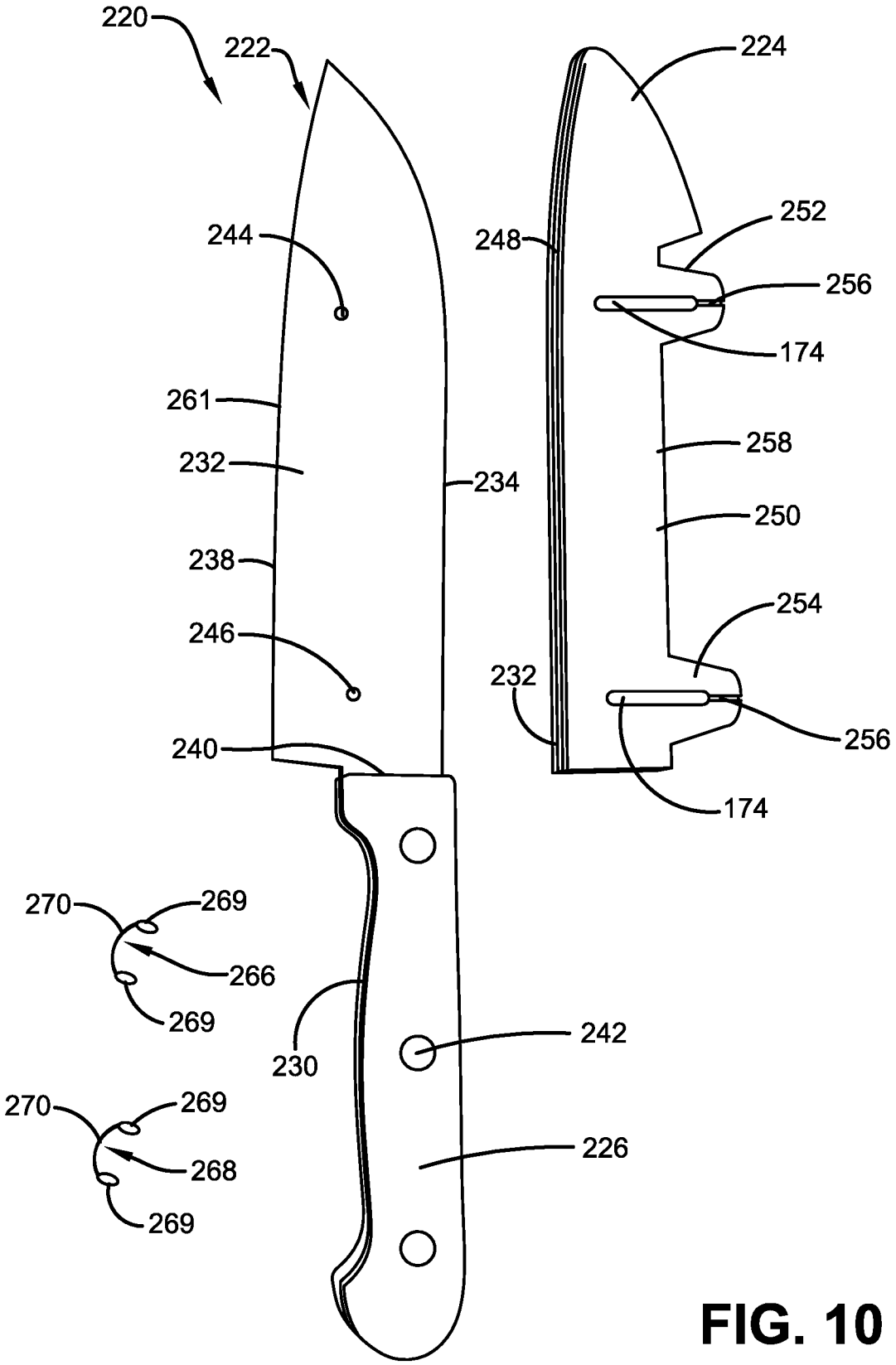
FIG. 10 is a partial exploded view of an apparatus from the right side according to a third embodiment of the present invention.
Figure 11:
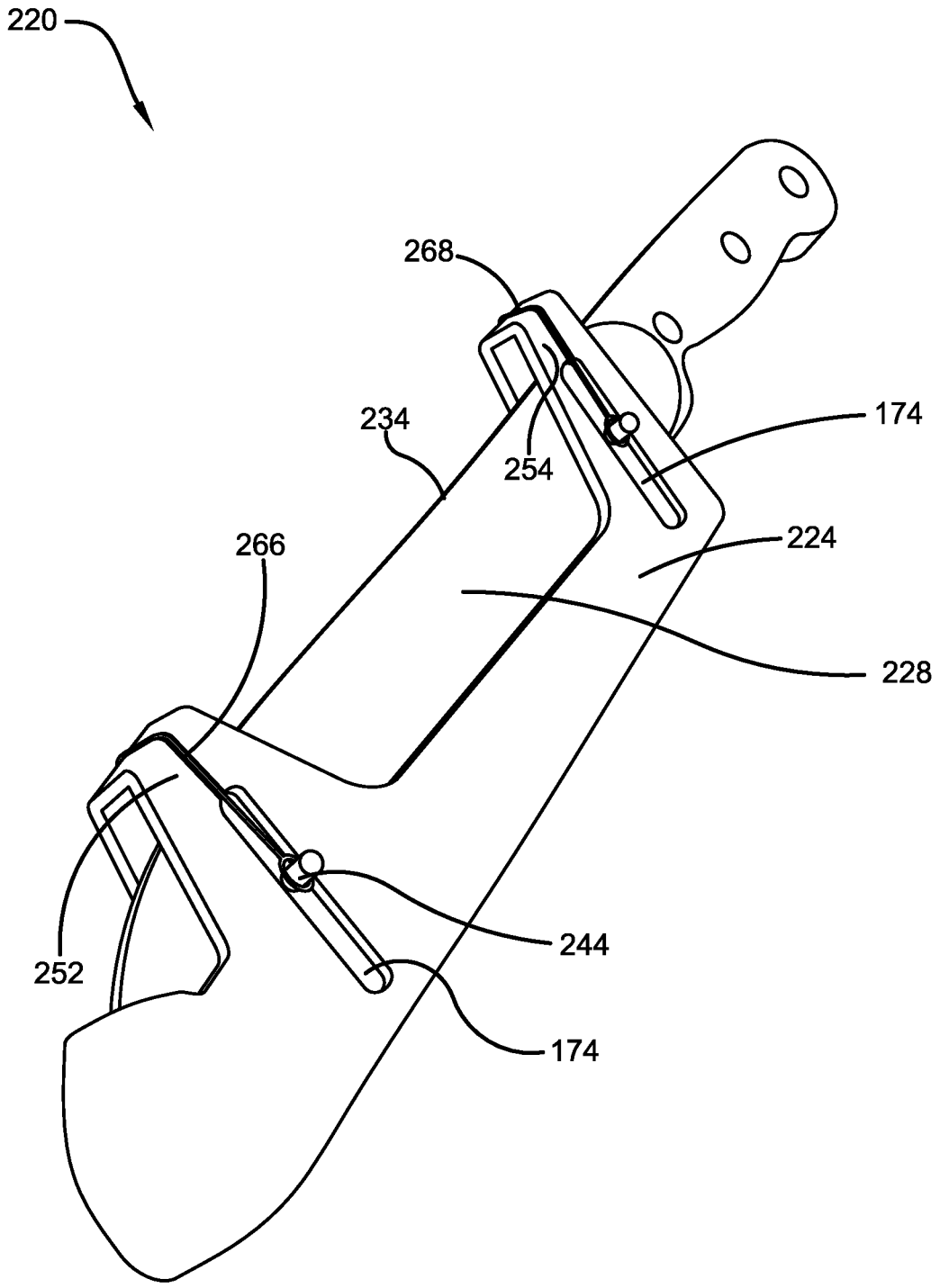
FIG. 11 is a front and right side perspective view of the apparatus of FIG. 10 in a stowed position.
Figure 12:
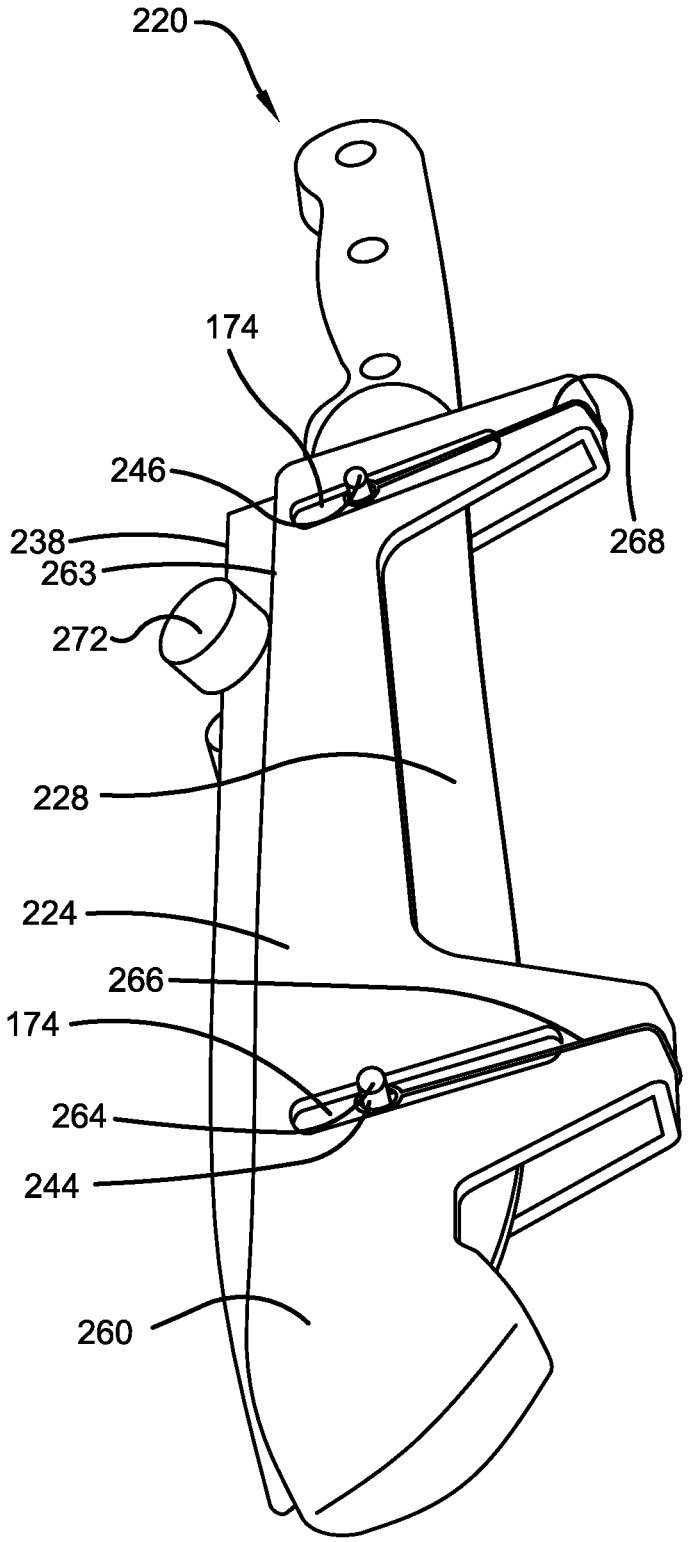
FIG. 12 is a front and left side perspective view of the apparatus of FIG. 10 in an operative position cutting a food item.

FIGS. 10-12 show an apparatus 220 according to a third embodiment of the present invention. The apparatus 220 comprises a knife 222 and a blade cover 224. The knife includes a handle 226 and a blade 228 attached to each other. The handle 226 may be made of a suitable material such as wood, thermoplastic elastomer, fiber glass reinforced nylon, or metal. The handle 226 includes a grip portion 230 for the user to grasp. The blade 228 includes a cheek 232, an upper spine 234, a tip 236, a cutting edge 238, and a tang 240. The tang 240 extends into the handle 226 and is attached to the handle 226 by any suitable way such as by rivets 242. Front and rear lateral pins 244, 246 extend laterally (right and left) through the blade and are located just below the upper spine 234 of the blade 228. The pins 244, 246 are spaced longitudinally from each other along the blade 228.

The cover 224 includes a bottom slot 248 that extends upwardly from the bottom end 249 of the cover to a top 250 of the cover 224. Front and rear stop cover portions 252, 254 are integrally formed with the cover 224 and extend upwardly from the top 250 of the cover 224. Each of the stop cover portions 252, 254 may include a top groove 256 that extends laterally across the top end of the stop cover portion 252 or 254. The bottom slot 248 is defined by right and left guard members 258, 260. The right and left guard members 258, 260 cover right and left sides 261, 263 of the cutting edge 238 and the upper spine 234 and the tip 236 of the blade 228 when installed on the blade 228 in the stowed position of the knife as shown in FIG. 11. The right and left guard members 258, 260 may extend downwardly beyond the cutting edge 238 in the stowed position at a distance of 1 to 3 millimeters. In one example, the right and left guard members 258, 260 may extend downwardly beyond the cutting edge 238 in the stowed position at a distance of 1 millimeter. Each of the right and left guard members 258, 260 may have a thickness (from right to left) from 1 to 10 millimeters. In one example, the right and left guard members 258, 260 may have a thickness (from right to left) of 2 millimeters.

Each of the guard members 258, 260 includes a pair of vertical slots 262. Each slot 262 is located at one of the respective stop cover portions 252, 254. Each slot 262 exposes an end 264 of the corresponding front pin 244 or rear pin 246. The apparatus 220 includes front and rear springs 266, 268. Each of the front and rear springs 266, 268 has looped axial ends 269 that are connected to each other by a flexible wire 270. When the cover 224 is assembled to the blade 228, each end 264 of the pins 244, 246 extends at least partially through a respective vertical slot 262. In the assembled condition of the cover 224 on the blade 228, the wire 270 of the front spring 266 is inserted into the top groove 256 of the front stop cover portion 252 and the right and left ends 264 of the front pin 244 are hooked into their respective looped ends 269 of the front spring 266. Similarly, the wire 270 of the rear spring 268 is inserted into the top groove 256 of the rear stop cover portion 254 and the right and left ends 264 of the rear pin 246 are hooked into their respective looped ends 269 of the rear spring 268. The biasing force of the springs 266, 268 urge the cover 224 downward against the upper spine 234 of the blade 228.

To cut a food item 272, the apparatus 220 is placed over the food item 272 to be cut. As the knife 222 cuts into the food item 272 in this operative position, the biasing force of the springs 266, 268 is overcome by the resistance force of the food item 272 being applied against the bottom end 249 of the cover 224 such that the cover 224 moves upwardly relative to the blade 228 away from cutting edge 238 to enable the knife 222 to cut through the food item 272 as illustrated in FIG. 12. The vertical slots 262 allow the pins 244, 246 to travel up and down relative to the cover 224 so that the cover 224 can move upwardly and downwardly relative to the blade 228. When the blade 228 and cover 224 are removed from the food item 272, there is no more resistance force from the food item 272 being applied against the bottom end 249 of the cover 224, so that the downward biasing force of the springs 266, 268 due to the tension of the springs 266, 268 causes the cover 224 to move back downwardly until the stop cover portions 252, 254 engage the upper spine 234 of the blade 228, thereby placing the knife cover 224 in the stowed position as illustrated in FIG. 11.

Figure 13:
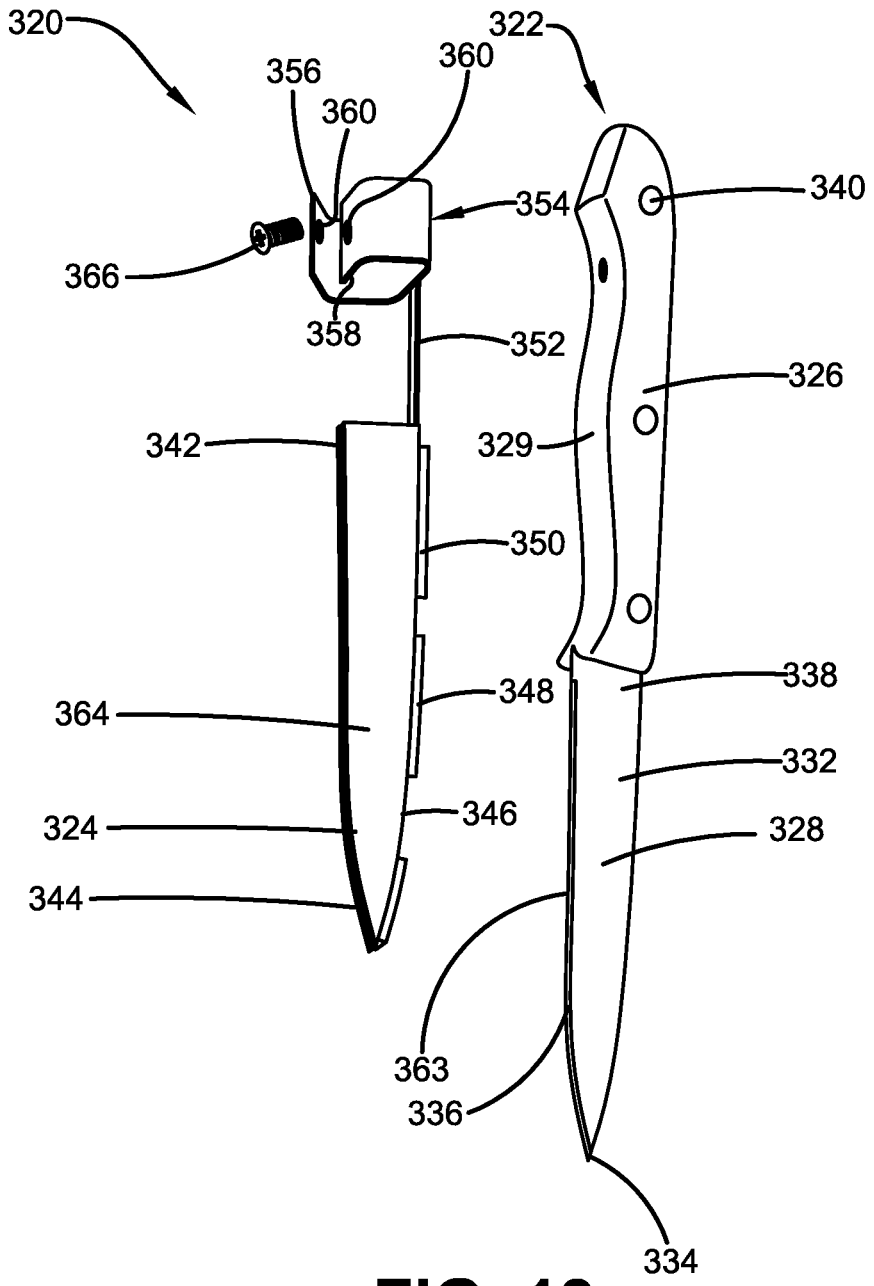
FIG. 13 is a partial exploded view from the left side of an apparatus according to a fourth embodiment of the present invention.
Figure 14:
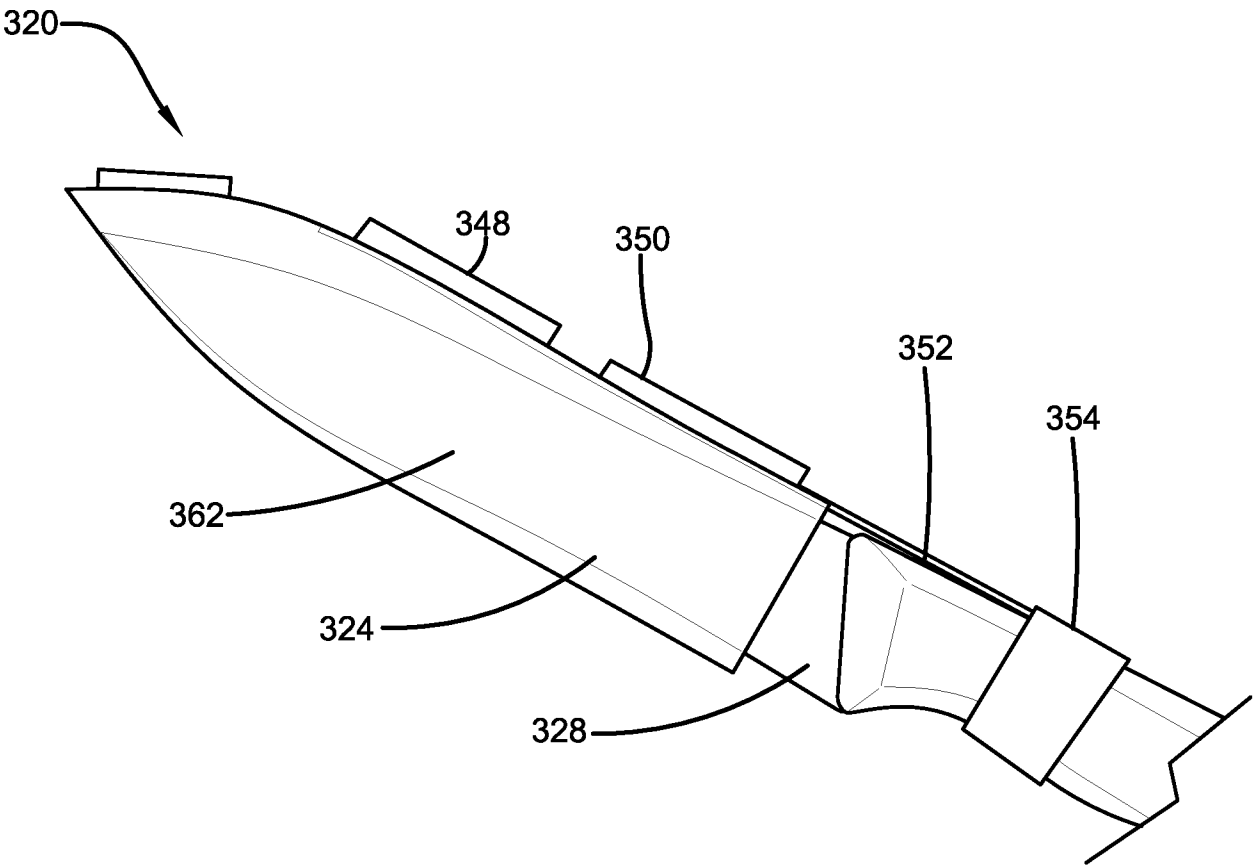
FIG. 14 is a right side view of a portion of the apparatus of FIG. 13 in a stowed position.
Figure 15:
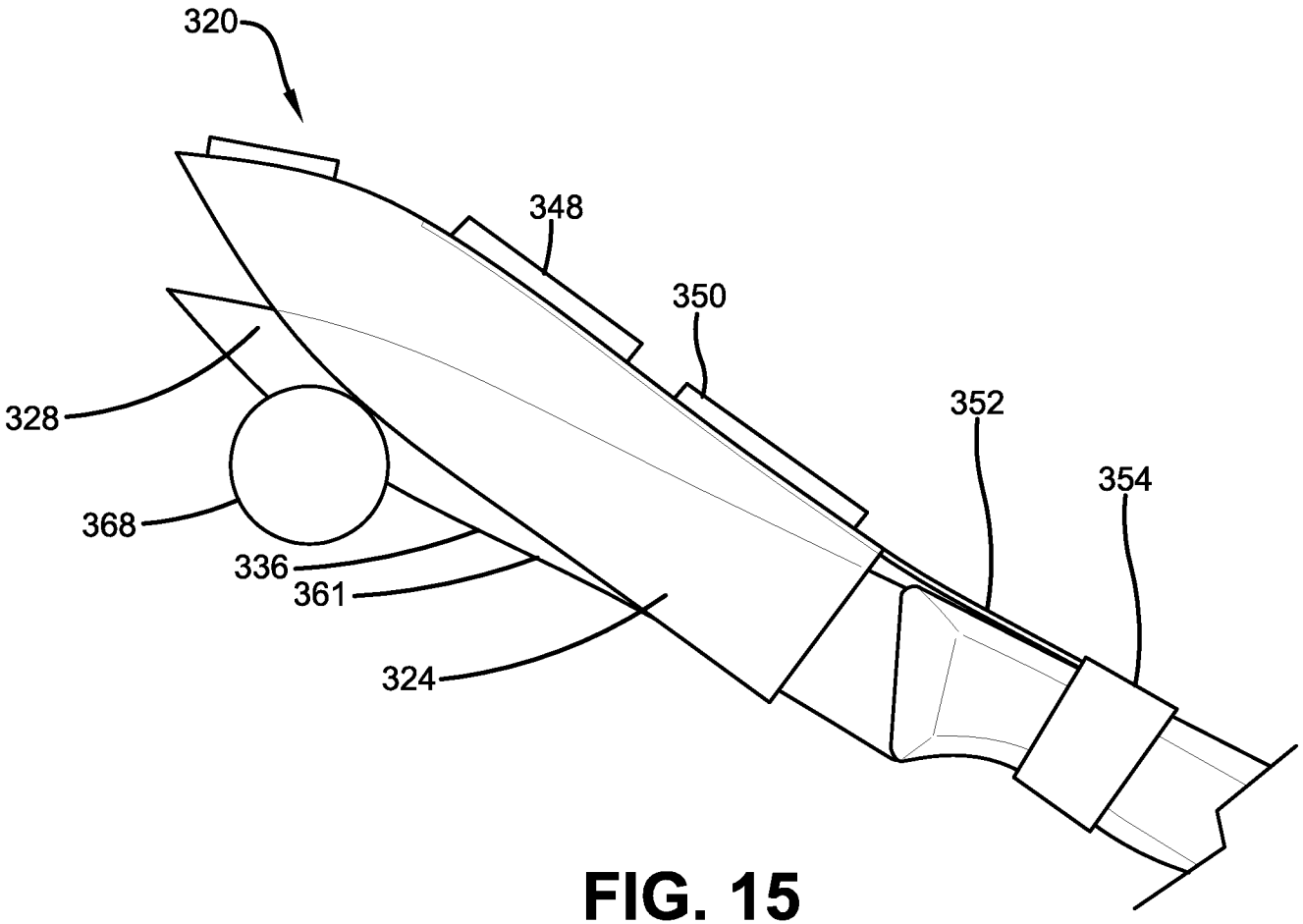
FIG. 15 is a right side view of the apparatus of FIG. 13 in an operative position cutting a food item.

FIGS. 13-15 show an apparatus 320 according to a fourth embodiment of the present invention. As seen in FIG. 13, the apparatus 320 comprises a knife 322 and a blade cover 324. The knife 322 includes a handle 326 and a blade 328 attached to each other. The handle 326 may be made of a suitable material such as wood, thermoplastic elastomer, fiber glass reinforced nylon, or metal. The handle includes a grip portion 329 for the user to grasp. The blade 328 includes a cheek 330, an upper spine 332, a tip 334, a cutting edge 336, and a tang 338. The tang 338 extends into the handle 326 and is attached to the handle 326 by any suitable way such as by rivets 340.

The cover 324 includes a bottom slot 342 that extends upwardly from the bottom end 344 of the cover to the top 346 of the cover. The top 346 of the cover includes front and rear sleeve portions 348, 350 that are covered. An elongated flexible flat spring 352 extends into the front and rear sleeve portions 348, 350 and is attached thereto. A handle holder 354 is integrally formed on the rear end of the flat spring 352 and extends laterally around the cross section of the handle 326. The holder 354 is c-shaped and includes first and second flanges 356, 358. Each of the flanges has a mounting aperture 360. The slot is defined by right and left guard members 362, 364. The right and left guard members 362, 364 cover right and left sides 361, 363 of the cutting edge 336, the upper spine 332, and the tip 334 of the blade 228 when installed on the blade 228 in the stowed position of the knife 322. The right and left guard members 362, 364 may extend downwardly beyond the cutting edge 336 in the stowed position at a distance of 1 to 3 millimeters. In one example, the right and left guard members 362, 364 may extend downwardly beyond the cutting edge 336 in the stowed position at a distance of 1 millimeter. Each of the right and left guard members 362, 364 may have a thickness (from right to left) from 1 to 10 millimeters. In one example, the right and left guard members 362, 364 may have a thickness (from right to left) of 2 millimeters.

Figure 16:
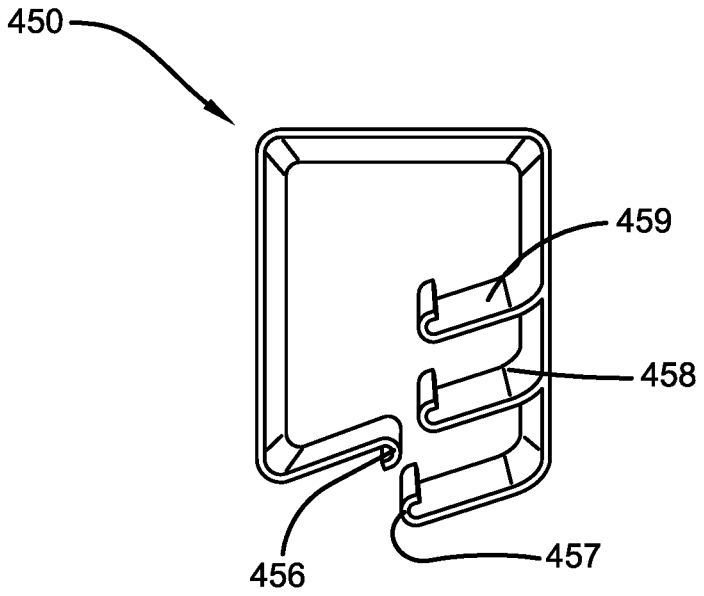
FIG. 16 is a rear side view of another version of the spring of the apparatus of FIG. 13.
Figure 17:
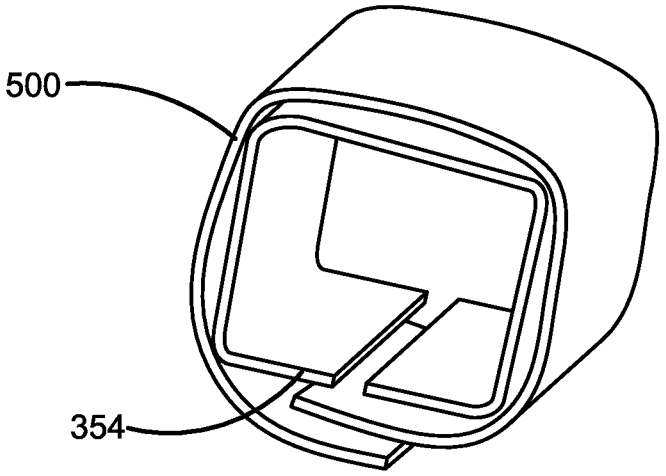
FIG. 17 is a top and rear perspective view of the holder with a strap wrapped around the holder of the apparatus of FIG. 13.

When the cover 324 is assembled to the blade 228, the blade 228 extends into the bottom slot 342 and the handle 326 is received by the holder 350. The first and second flanges 356, 358 overlap each other such that the mounting apertures 360 are aligned with each other. A screw 366 is extends through the mounting apertures 360 and is screwed into the handle 326 to secure the holder 354 and cover 324 to the handle. Alternatively, the flanges may define hooks 456, 457 (FIG. 16) that attach to each other in an interlocking arrangement without the use of the screw 366 to attach the holder 354 to the handle 326. Additional flanges that define hooks 458, 459 may be attached to the holder 350 in which the hook 456 can attach to in an interlocking arrangement to adjust the size of the opening defined by the strap 500 overlapping itself to accommodate a variety of handles with different thicknesses. Alternatively, or additionally, a strap 500 (FIG. 17) such as a Velcro® strap may be wrapped around the holder 354, overlapping itself and removably attached to itself to secure the holder 354 to the handle 326. The strap 500 may be attached to itself at selected locations along the strap 500 to adjust the size of the opening defined by the strap 500 overlapping itself to accommodate a variety of handles with different thicknesses. In the assembled condition of the cover 324 on the blade 328, the biasing force of the spring 352 urges the cover 324 downward against the upper spine 332 of the blade 328 in the stowed position as shown in FIG. 14.

To cut a food item 368, the apparatus 320 is placed over the food item 368 to be cut. As the knife 322 cuts into the food item 368 in this operative position, the biasing force of the spring 352 is overcome by the resistance force of the food item 368 being applied against the bottom end 344 of the cover 324 such that the cover 324 moves upwardly relative to the blade 328 away from cutting edge 336 to enable the knife 322 to cut through the food item 368 as illustrated in FIG. 15. When the blade 328 and the cover 324 are removed from the food item 368, there is no more resistance force from the food item 368 being applied against the bottom end 344 of the cover 324, so that the downward biasing force of the spring 352 due to the tension of the spring 352 causes the cover 324 to move back downwardly until the stop cover portions 348. 350 engage the upper spine 332 of the blade 328, thereby placing the knife cover 324 in the stowed position as illustrated in FIGS. 13 and 14.

The movable knife blade cover creates a space between the fingers of the user and the blade of the knife from the top and opposite right and left sides of the blade while cutting the food items on the cutting board or other flat surface to prevent the fingers from reaching the blade. The invention is especially beneficial in protecting the fingers of child users, users just learning how to cut food items with a knife, and blind users. Another benefit of the movable knife blade cover is that it covers the blade of the knife at all times to prevent a kid or anyone else touching the blade accidentally.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above-described embodiments, method, and examples, but by all embodiments and methods within the scope and spirit of the invention.

What is claimed is:

1. An apparatus comprising:

a knife, wherein the knife comprises a handle and a blade, wherein the handle is attached to the blade, wherein the blade includes a cutting edge, a cheek, and an upper spine, wherein the cheek extends between the cutting edge and the upper spine;

a blade cover, wherein the blade cover covers opposite sides of the cutting edge of the blade, wherein the blade cover covers at least a portion of the upper spine in a stowed position;

a biasing device, wherein the biasing device is in operative connection with the knife and the blade cover, wherein the biasing device is operative to bias the blade cover down against the upper spine in the stowed position, wherein the biasing device is a torsional spring, wherein the torsional spring includes a coiled portion and first and second legs, wherein the coiled portion is secured to the handle, wherein the blade cover includes a sleeve portion, wherein the sleeve portion is formed at a top end of the blade cover, wherein the first leg is received by the sleeve portion, wherein the second leg engages the handle to cause the first leg to bias the blade cover down against the upper spine; and wherein the blade cover is in operative connection with the knife, wherein the blade cover is operative to move relative to the blade in a direction away from the cutting edge when the blade cuts an object to enable the blade to cut the object.

2. The apparatus of claim 1, wherein the blade cover includes a bottom groove that is defined by first and second guard members, wherein the first and second guard members at least partially cover opposite sides of the cheek.

3. The apparatus of claim 2, wherein the bottom groove has an open bottom end, wherein the bottom groove has a top end, wherein a rear portion of the top end is opened at a dimension that enables a tip of the blade to be inserted into the bottom groove.

4. The apparatus of claim 1 further comprising a first fastener, wherein the blade cover includes a rear portion, wherein the handle includes first and second tabs, wherein the rear portion of the cover is positioned between the first and second tabs, wherein the first fastener extends through the first and second tabs to secure the blade cover to the handle, wherein the blade cover is operative to pivot relative to the blade about the first fastener.

5. The apparatus of claim 4 further comprising a second fastener, wherein the handle includes third and fourth tabs, wherein the coiled portion is positioned between the third and fourth tabs, wherein the second fastener extends through the coiled portion and the third and fourth tabs to secure the torsional spring to the handle.

6. The apparatus of claim 1 further comprising a fastener, wherein the handle includes first and second tabs, wherein the coiled portion is positioned between the first and second tabs, wherein the fastener extends through the coiled portion and the first and second tabs to secure the torsional spring to the handle.

* * * * *